US011282330B2

(12) United States Patent
Small et al.

(10) Patent No.: US 11,282,330 B2
(45) Date of Patent: Mar. 22, 2022

(54) MULTIPLE SIMULTANEOUS PRESSURE SENSITIVE INPUTS FOR GAMING DEVICES, AND RELATED DEVICES, SYSTEMS, AND METHODS

(71) Applicant: IGT, Las Vegas, NV (US)

(72) Inventors: David Small, Moncton (CA); Michael Russ, Graz (AT); Sven Aurich, Schwanberg (AT)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/569,286

(22) Filed: Sep. 12, 2019

(65) Prior Publication Data

US 2021/0082232 A1 Mar. 18, 2021

(51) Int. Cl.
*G07F 17/32* (2006.01)
*G07F 17/34* (2006.01)

(52) U.S. Cl.
CPC ..... *G07F 17/3209* (2013.01); *G07F 17/3213* (2013.01); *G07F 17/3262* (2013.01); *G07F 17/34* (2013.01)

(58) Field of Classification Search
None
See application file for complete search history.

(56) References Cited

U.S. PATENT DOCUMENTS 8,241,912 B2 8/2012 Loose
8,926,421 B2 1/2015 Arezina et al.
8,956,224 B2 2/2015 Gagner et al.
9,005,001 B2 4/2015 Jones et al.
9,235,267 B2 1/2016 Burrough et al.
9,384,626 B2 7/2016 Walker et al.
10,180,723 B2 1/2019 Lisseman et al.
10,222,895 B1 * 3/2019 Smith ..... G06F 3/0412
2006/0211494 A1 * 9/2006 Helfer ..... G07F 17/3211 463/30
2009/0143141 A1 6/2009 Wells et al.
2011/0117999 A1 * 5/2011 Anderson ..... G07F 17/3262 463/20
2011/0287824 A1 * 11/2011 Schultz ..... G07F 17/34 463/20

(Continued)

FOREIGN PATENT DOCUMENTS

CN 103210429 10/2016

*Primary Examiner* — Jason T Yen
(74) *Attorney, Agent, or Firm* — Sage Patent Group

(57) ABSTRACT

Devices, systems, and methods for providing multiple simultaneous pressure sensitive inputs for gaming devices include an input device including a plurality of input locations and a pressure sensor to detect, for each input location of the plurality of input locations, an amount of pressure applied to the input device at the input location by a player of the gaming device. A processor circuit receives, from the pressure sensor, a first pressure parameter value corresponding to a first amount of pressure being applied to a first input location of the plurality of input locations by the player, and a second pressure parameter value to a second amount of pressure being applied to a second input location of the plurality of input locations by the player. Based on the first pressure parameter value and the second pressure parameter value, the processor circuit modifies a user interface element of the gaming device.

19 Claims, 15 Drawing Sheets

(56) References Cited

U.S. PATENT DOCUMENTS

| | | | | |
|---|---|---|---|---|
| 2012/0052937 | A1* | 3/2012 | Jones | G07F 17/3206 463/20 |
| 2012/0094737 | A1* | 4/2012 | Barclay | G07F 17/34 463/20 |
| 2015/0296062 | A1* | 10/2015 | Lee | G02F 1/13439 455/566 |
| 2015/0379808 | A1* | 12/2015 | Rosenblatt | G07F 17/3239 463/20 |
| 2017/0092038 | A1* | 3/2017 | Vann | G07F 17/3286 |
| 2019/0249962 | A1* | 8/2019 | Hong | G07F 17/3202 |

* cited by examiner

MULTIPLE SIMULTANEOUS PRESSURE SENSITIVE INPUTS FOR GAMING DEVICES, AND RELATED DEVICES, SYSTEMS, AND METHODS

BACKGROUND

Embodiments described herein relate to providing input for gaming devices, and in particular to multiple simultaneous pressure sensitive inputs for gaming devices, and related devices, systems, and methods.

Gaming devices, such as electronic gaming machines (EGMs), may provide input devices for facilitating play of a game by a player at the gaming device, and for providing additional interactive functionality at the gaming device. Many conventional gaming devices employ relatively simple input devices, such as buttons or keypads, which limit the features and functionality that can be offered at the gaming device.

BRIEF SUMMARY

According to an embodiment, a gaming device includes an input device including a plurality of input locations and a pressure sensor to detect, for each input location of the plurality of input locations, an amount of pressure applied to the input device at the input location by a player of the gaming device. The gaming device further includes a processor circuit, and a memory coupled to the processor circuit. The memory include machine-readable instructions that, when executed by the processor circuit, cause the processor circuit to receive, from the pressure sensor, a first pressure parameter value corresponding to a first amount of pressure being applied to a first input location of the plurality of input locations by the player. The instructions further cause the processor circuit to receive, from the pressure sensor, a second pressure parameter value to a second amount of pressure being applied to a second input location of the plurality of input locations by the player. The instructions further cause the processor circuit to, based on the first pressure parameter value and the second pressure parameter value, modify a user interface element of the gaming device.

According to another embodiment, a method includes detecting, by a pressure sensor of an input device of a gaming device, a first amount of pressure being applied by a player to a first input location of a plurality of input locations. The method further includes generating, by the pressure sensor, a first pressure parameter value corresponding to the first amount of pressure being applied to the first input location. The method further includes detecting, by the pressure sensor, a second amount of pressure being applied by the player to a second input location of the plurality of input locations. The method further includes generating, by the pressure sensor, a second pressure parameter value corresponding to the second amount of pressure being applied to the second input location. The method further includes receiving, from the pressure sensor by a processor circuit of the gaming device, the first pressure parameter value and the second pressure parameter value. The method further includes modifying, by the processor circuit, a user interface element of the gaming device based on the first pressure parameter value and the second pressure parameter value.

According to another embodiment a system includes a processor circuit and a memory coupled to the processor circuit. The memory includes machine-readable instructions that, when executed by the processor circuit, cause the processor circuit to receive, from a pressure sensor of an input device comprising a plurality of input locations, a first pressure parameter value corresponding to a first amount of pressure being applied by a player to a first input location of the plurality of input locations. The instructions further cause the processor circuit to receive, from the pressure sensor, a second pressure parameter value to a second amount of pressure being applied by the player to a second input location of the plurality of input locations. The instructions further cause the processor circuit to, based on the first pressure parameter value and the second pressure parameter value, modify a user interface element of the gaming device.

DETAILED DESCRIPTION

According to embodiments described herein, multiple simultaneous pressure sensitive inputs for gaming devices, and related devices, systems, and methods, may provide unique technical solutions for the technical problem of providing accessible and intuitive input interface while providing complex functionality for gaming devices. For example, a gaming device may include an input device including a plurality of input locations and a pressure sensor to detect, for each input location of the plurality of input locations, an amount of pressure applied to the input device at the input location by a player of the gaming device. A processor circuit receives, from the pressure sensor, a first pressure parameter value corresponding to a first amount of pressure being applied to a first input location of the plurality of input locations by the player. The processor circuit also receives, from the pressure sensor, a second pressure parameter value to a second amount of pressure being applied to a second input location of the plurality of input locations by the player. Based on the first pressure parameter value and the second pressure parameter value, the processor circuit modifies a user interface element of the gaming device.

Figure 1:
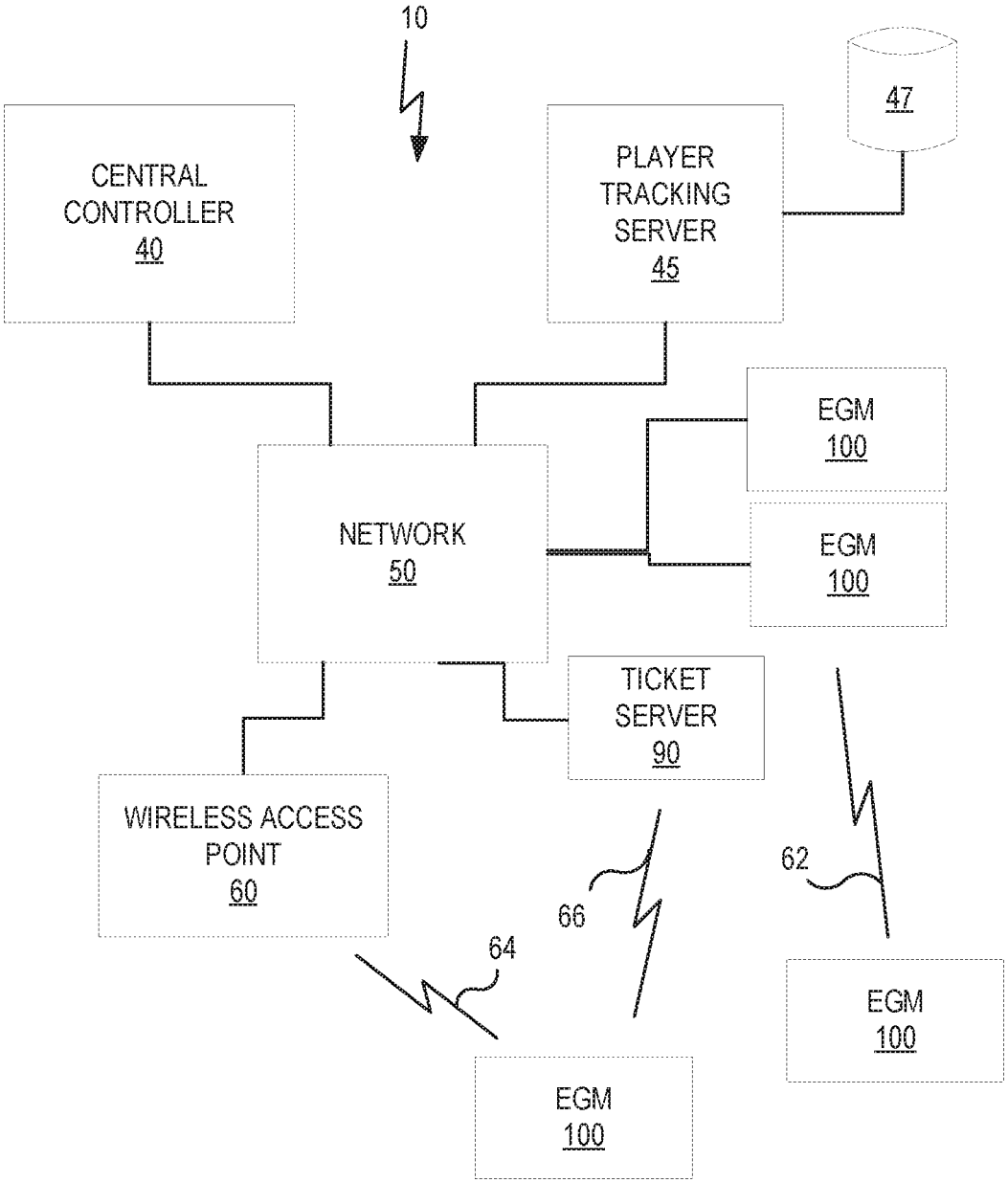
FIG. 1 is a schematic block diagram illustrating a network configuration for a plurality of gaming devices according to some embodiments.

Referring to FIG. 1, a gaming system 10 including a plurality of gaming devices 100 is illustrated. As discussed above, the gaming devices 100 may be one type of a variety of different types of gaming devices, such as electronic gaming machines (EGMs), mobile devices, or other devices, for example. The gaming system 10 may be located, for example, on the premises of a gaming establishment, such as a casino. The gaming devices 100, which are typically situated on a casino floor, may be in communication with each other and/or at least one central controller 40 through a data communication network 50 that may include a remote communication link. The data communication network 50 may be a private data communication network that is operated, for example, by the gaming facility that operates the gaming devices 100. Communications over the data communication network 50 may be encrypted for security. The central controller 40 may be any suitable server or computing device which includes at least one processing circuit and at least one memory or storage device. Each gaming device 100 may include a processing circuit that transmits and receives events, messages, commands or any other suitable data or signal between the gaming device 100 and the central controller 40. The gaming device processing circuit is operable to execute such communicated events, messages or commands in conjunction with the operation of the gaming device 100. Moreover, the processing circuit of the central controller 40 is configured to transmit and receive events, messages, commands or any other suitable data or signal between the central controller 40 and each of the individual gaming devices 100. In some embodiments, one or more of the functions of the central controller 40 may be performed by one or more gaming device processing circuits. Moreover, in some embodiments, one or more of the functions of one or more gaming device processing circuits as disclosed herein may be performed by the central controller 40.

A wireless access point 60 provides wireless access to the data communication network 50. The wireless access point 60 may be connected to the data communication network 50 as illustrated in FIG. 1, and/or may be connected directly to the central controller 40 or another server connected to the data communication network 50.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

As further illustrated in FIG. 1, the gaming system 10 may include a ticket server 90 that is configured to print and/or dispense wagering tickets. The ticket server 90 may be in communication with the central controller 40 through the data communication network 50. Each ticket server 90 may include a processing circuit that transmits and receives events, messages, commands or any other suitable data or signal between the ticket server 90 and the central controller 40. The ticket server 90 processing circuit may be operable to execute such communicated events, messages or commands in conjunction with the operation of the ticket server 90. Moreover, in some embodiments, one or more of the functions of one or more ticket server 90 processing circuits as disclosed herein may be performed by the central controller 40.

The gaming devices 100 communicate with one or more elements of the system 10 to coordinate providing wagering games and other functionality. For example, in some embodiments, the gaming device 100 may communicate directly with the ticket server 90 over a wireless interface 62, which may be a WiFi link, a Bluetooth link, an NFC link, etc. In other embodiments, the gaming device 100 may communicate with the data communication network 50 (and devices connected thereto, including other gaming devices 100) over a wireless interface 64 with the wireless access point 60. The wireless interface 64 may include a WiFi link, a Bluetooth link, an NFC link, etc. In still further embodiments, the gaming devices 100 may communicate simultaneously with both the ticket server 90 over the wireless interface 66 and the wireless access point 60 over the wireless interface 64. Some embodiments provide that gaming devices 100 may communicate with other gaming devices over a wireless interface 64. In these embodiments, wireless interface 62, wireless interface 64 and wireless interface 66 may use different communication protocols and/or different communication resources, such as different frequencies, time slots, spreading codes, etc.

Gaming Devices

Figure 2A:
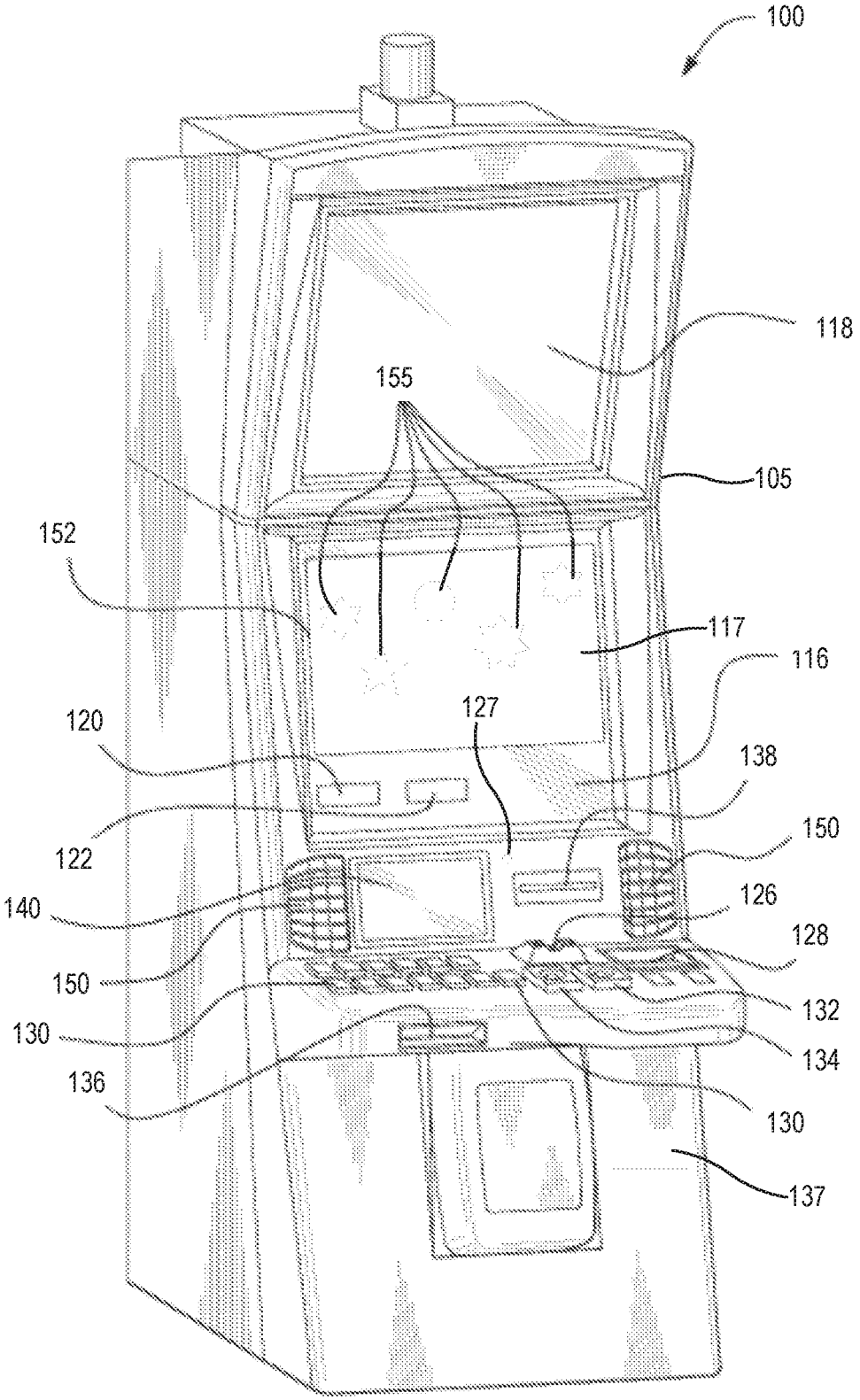
FIG. 2A is a perspective view of a gaming device that can be configured according to some embodiments.
Figure 2B:
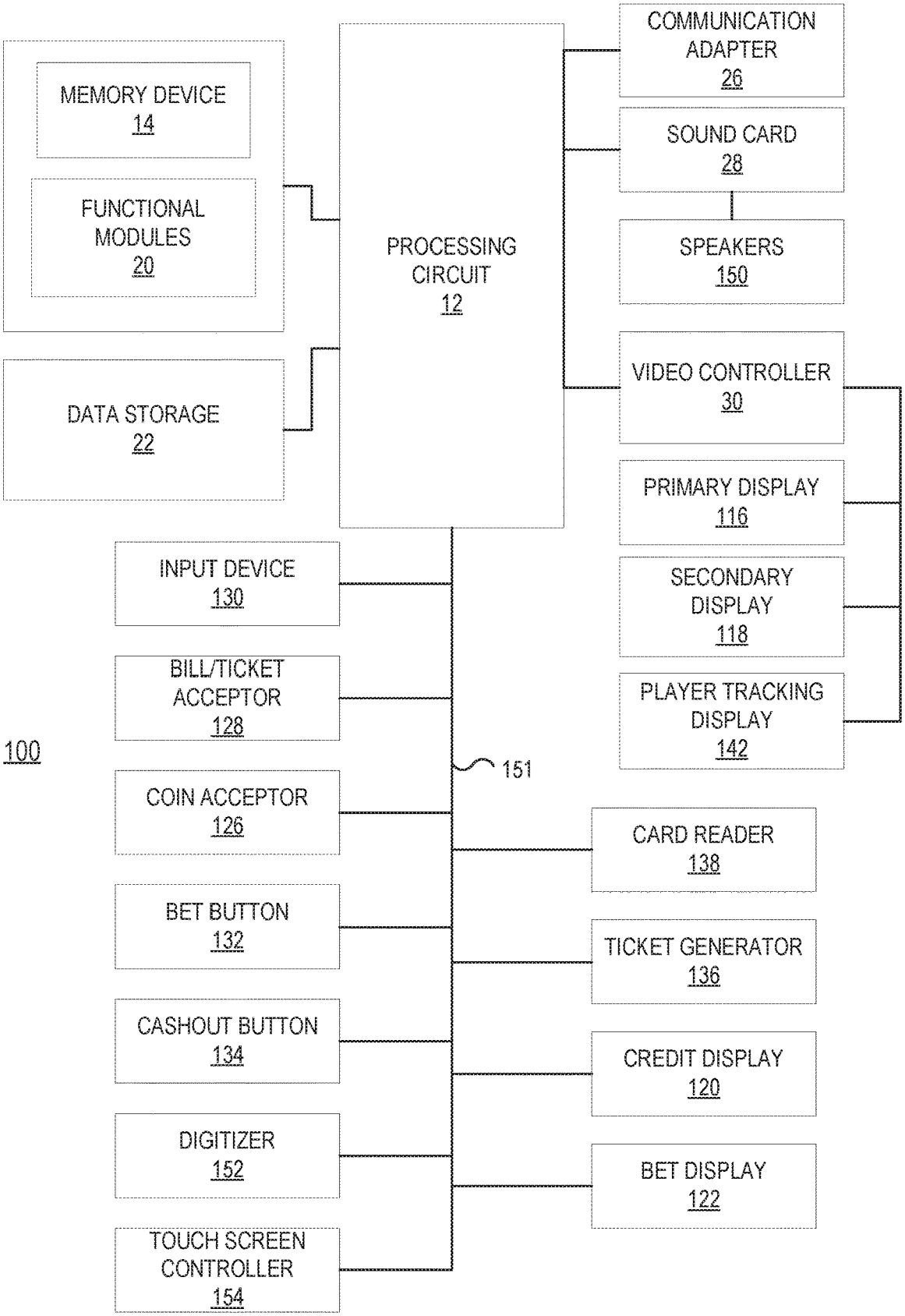
FIG. 2B is a schematic block diagram illustrating an electronic configuration for a gaming device according to some embodiments.
Figure 2C:
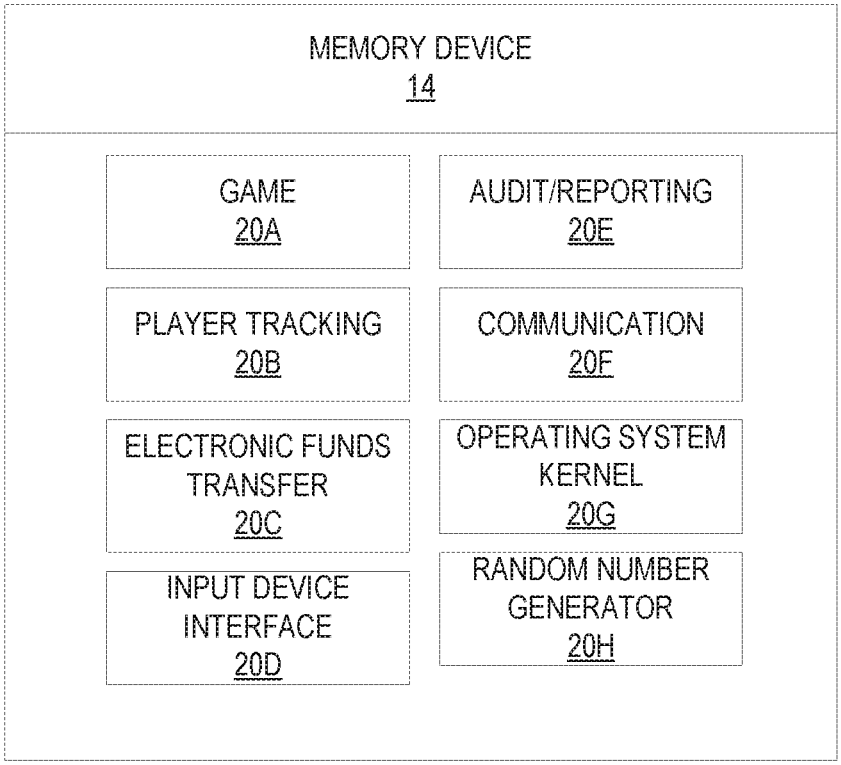
FIG. 2C is a schematic block diagram that illustrates various functional modules of a gaming device according to some embodiments.

Embodiments herein may include different types of gaming devices. One example of a gaming device includes a gaming device 100 that can use pressure and time sensitive inputs according to various embodiments is illustrated in FIGS. 2A, 2B, and 2C in which FIG. 2A is a perspective view of a gaming device 100 illustrating various physical features of the device, FIG. 2B is a functional block diagram that schematically illustrates an electronic relationship of various elements of the gaming device 100, and FIG. 2C illustrates various functional modules that can be stored in a memory device of the gaming device 100. The embodiments shown in FIGS. 2A to 2C are provided as examples for illustrative purposes only. It will be appreciated that gaming devices may come in many different shapes, sizes, layouts, form factors, and configurations, and with varying numbers and types of input and output devices, and that embodiments of the inventive concepts are not limited to the particular gaming device structures described herein.

Gaming devices 100 typically include a number of standard features, many of which are illustrated in FIGS. 2A and 2B. For example, referring to FIG. 2A, a gaming device 100 may include a support structure, housing 105 (e.g., cabinet) which provides support for a plurality of displays, inputs, outputs, controls and other features that enable a player to interact with the gaming device 100.

The gaming device 100 illustrated in FIG. 2A includes a number of display devices, including a primary display device 116 located in a central portion of the housing 105 and a secondary display device 118 located in an upper portion of the housing 105. A plurality of game components 155 are displayed on a display screen 117 of the primary display device 116. It will be appreciated that one or more of the display devices 116, 118 may be omitted, or that the display devices 116, 118 may be combined into a single display device. The gaming device 100 may further include a player tracking display 142, a credit display 120, and a bet display 122. The credit display 120 displays a player's current number of credits, cash, account balance or the equivalent. The bet display 122 displays a player's amount wagered. Locations of these displays are merely illustrative as any of these displays may be located anywhere on the gaming device 100.

The player tracking display 142 may be used to display a service window that allows the player to interact with, for example, their player loyalty account to obtain features, bonuses, comps, etc. In other embodiments, additional display screens may be provided beyond those illustrated in FIG. 2A. In some embodiments, one or more of the player tracking display 142, the credit display 120 and the bet display 122 may be displayed in one or more portions of one or more other displays that display other game related visual content. For example, one or more of the player tracking display 142, the credit display 120 and the bet display 122 may be displayed in a picture in a picture on one or more displays.

The gaming device 100 may further include a number of pressure sensitive input devices 130 that allow a player to provide various inputs to the gaming device 100, either before, during or after a game has been played. The gaming device may further include a game play initiation button 132 and a cashout button 134. The cashout button 134 is utilized to receive a cash payment or any other suitable form of payment corresponding to a quantity of remaining credits of a credit display.

In some embodiments, one or more input devices of the gaming device 100 are one or more game play activation devices that are each used to initiate a play of a game on the gaming device 100 or a sequence of events associated with the gaming device 100 following appropriate funding of the gaming device 100. The example gaming device 100 illustrated in FIGS. 2A and 2B includes a game play activation device in the form of a game play initiation button 132. It should be appreciated that, in other embodiments, the gaming device 100 begins game play automatically upon appropriate funding rather than upon utilization of the game play activation device.

In some embodiments, one or more pressure sensitive input device 130 of the gaming device 100 may include wagering or betting functionality. For example, a maximum wagering or betting function may be provided that, when utilized, causes a maximum wager to be placed. Another such wagering or betting function is a repeat the bet device that, when utilized, causes the previously-placed wager to be placed. A further such wagering or betting function is a bet one function. A bet is placed upon utilization of the bet one function. The bet is increased by one credit each time the bet one device is utilized. Upon the utilization of the bet one function, a quantity of credits shown in a credit display (as described below) decreases by one, and a number of credits shown in a bet display (as described below) increases by one.

In some embodiments, one or more of the display screens may a touch-sensitive display that includes a digitizer 152 and a touchscreen controller 154 (FIG. 2B). The player may interact with the gaming device 100 by touching virtual buttons on one or more of the display devices 116, 118, 140. Accordingly, any of the above described input devices, such as the pressure sensitive input device 130, the game play initiation button 132 and/or the cashout button 134 may be provided as virtual buttons or regions on one or more of the display devices 116, 118, 140.

Referring briefly to FIG. 2B, operation of the primary display device 116, the secondary display device 118 and the player tracking display 142 may be controlled by a video controller 30 that receives video data from a processing circuit 12 or directly from a memory device 14 and displays the video data on the display screen. The credit display 120 and the bet display 122 are typically implemented as simple LCD or LED displays that display a number of credits available for wagering and a number of credits being wagered on a particular game. Accordingly, the credit display 120 and the bet display 122 may be driven directly by the processing circuit 12. In some embodiments however, the credit display 120 and/or the bet display 122 may be driven by the video controller 30.

Referring again to FIG. 2A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touch-screen with an associated touchscreen controller 154 and digitizer 152. The display devices 116, 118, 140 may be of any suitable size, shape, and/or configuration. The display devices 116, 118, 140 may include flat or curved display surfaces.

The display devices 116, 118, 140 and video controller 30 of the gaming device 100 are generally configured to display one or more game and/or non-game images, symbols, and indicia. In certain embodiments, the display devices 116, 118, 140 of the gaming device 100 are configured to display any suitable visual representation or exhibition of the movement of objects; dynamic lighting; video images; images of people, characters, places, things, and faces of cards; and the like. In certain embodiments, the display devices 116, 118, 140 of the gaming device 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The gaming device 100 also includes various features that enable a player to deposit credits in the gaming device 100 and withdraw credits from the gaming device 100, such as in the form of a payout of winnings, credits, etc. For example, the gaming device 100 may include a ticket dispenser 136, a bill/ticket acceptor 128, and a coin acceptor 126 that allows the player to deposit coins into the gaming device 100.

As illustrated in FIG. 2A, the gaming device 100 may also include a currency dispenser 137 that may include a note dispenser configured to dispense paper currency and/or a coin generator configured to dispense coins or tokens in a coin payout tray.

The gaming device 100 may further include one or more speakers 150 controlled by one or more sound cards 28 (FIG. 2B). The gaming device 100 illustrated in FIG. 2A includes a pair of speakers 150. In other embodiments, additional speakers, such as surround sound speakers, may be provided within or on the housing 105. Moreover, the gaming device 100 may include built-in seating with integrated headrest speakers.

In various embodiments, the gaming device 100 may generate dynamic sounds coupled with attractive multimedia images displayed on one or more of the display devices 116, 118, 140 to provide an audio-visual representation or to otherwise display full-motion video with sound to attract players to the gaming device 100 and/or to engage the player during gameplay. In certain embodiments, the gaming device 100 may display a sequence of audio and/or visual attraction messages during idle periods to attract potential players to the gaming device 100. The videos may be customized to provide any appropriate information.

The gaming device 100 may further include a card reader 138 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processing circuit determines the amount of funds entered and displays the corresponding amount on the credit or other suitable display as described above.

In some embodiments, the gaming device 100 may include an electronic payout device or module configured to fund an electronically recordable identification card or smart card or a bank or other account via an electronic funds transfer to or from the gaming device 100.

FIG. 2B is a block diagram that illustrates logical and functional relationships between various components of a gaming device 100. It should also be understood that components described in FIG. 2B may also be used in other computing devices, as desired, such as mobile computing devices for example. As shown in FIG. 2B, the gaming device 100 may include a processing circuit 12 that controls operations of the gaming device 100. Although illustrated as a single processing circuit, multiple special purpose and/or general purpose processors and/or processor cores may be provided in the gaming device 100. For example, the gaming device 100 may include one or more of a video processor, a signal processor, a sound processor and/or a communication controller that performs one or more control functions within the gaming device 100. The processing circuit 12 may be variously referred to as a "controller," "microcontroller," "microprocessor" or simply a "computer." The processor may further include one or more application-specific integrated circuits (ASICs).

Various components of the gaming device 100 are illustrated in FIG. 2B as being connected to the processing circuit 12. It will be appreciated that the components may be connected to the processing circuit 12 through a system bus, a communication bus and controller, such as a USB controller and USB bus, a network interface, or any other suitable type of connection.

The gaming device 100 further includes a memory device 14 that stores one or more functional modules 20. Various functional modules 20 of the gaming device 100 will be described in more detail below in connection with FIG. 2D.

The memory device 14 may store program code and instructions, executable by the processing circuit 12, to control the gaming device 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The gaming device 100 may further include a data storage 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The gaming device 100 may include a communication adapter 26 that enables the gaming device 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the gaming device 100 to communicate, for example, with a mobile communication device operated by a player.

The gaming device 100 may include one or more internal or external communication ports that enable the processing circuit 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processing circuit through a universal serial bus (USB) hub (not shown) connected to the processing circuit 12.

In some embodiments, the gaming device 100 may include a sensor, such as a camera in communication with the processing circuit 12 (and possibly controlled by the processing circuit 12) that is selectively positioned to acquire an image of a player actively using the gaming device 100 and/or the surrounding area of the gaming device 100. In one embodiment, the camera may be configured to selectively acquire still or moving (e.g., video) images and may be configured to acquire the images in either an analog, digital or other suitable format. The display devices 116, 118, 140 may be configured to display the image acquired by the camera as well as display the visible manifestation of the game in split screen or picture-in-picture fashion. For example, the camera may acquire an image of the player and the processing circuit 12 may incorporate that image into the primary and/or secondary game as a game image, symbol or indicia.

Various functional modules of that may be stored in a memory device 14 of a gaming device 100 are illustrated in FIG. 2C. Referring to FIG. 2C, the gaming device 100 may include in the memory device 14 a game module 20A that includes program instructions and/or data for operating a hybrid wagering game as described herein. The gaming device 100 may further include a player tracking module 20B, an electronic funds transfer module 20C, an input device interface 20D, an audit/reporting module 20E, a communication module 20F, an operating system kernel 20G and a random number generator 20H. The player tracking module 20B keeps track of the play of a player. The electronic funds transfer module 20C communicates with a back end server or financial institution to transfer funds to and from an account associated with the player. The input device interface 20D interacts with input devices, such as the pressure sensitive input device 130, as described in more detail below. The communication module 20F enables the gaming device 100 to communicate with remote servers and other gaming devices using various secure communication interfaces. The operating system kernel 20G controls the overall operation of the gaming device 100, including the loading and operation of other modules. The random number generator 20H generates random or pseudorandom numbers for use in the operation of the hybrid games described herein.

In some embodiments, a gaming device 100 comprises a personal device, such as a desktop computer, a laptop computer, a mobile device, a tablet computer or computing device, a personal digital assistant (PDA), or other portable computing devices. In some embodiments, the gaming device 100 may be operable over a wireless network, such as part of a wireless gaming system. In such embodiments, the gaming machine may be a hand-held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission.

Figure 2D:
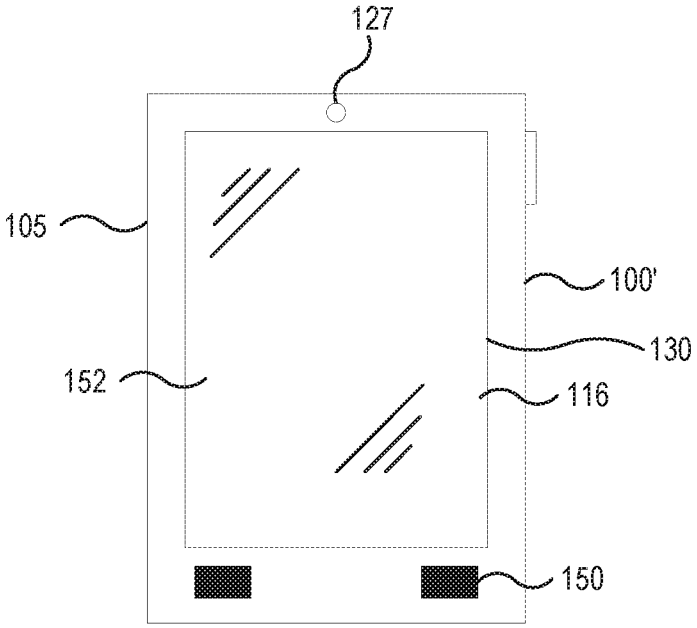
FIG. 2D is perspective view of a gaming device that can be configured according to some embodiments.

For example, referring to FIG. 2D, a gaming device 100' may be implemented as a handheld device including a compact housing 105 on which is mounted a touchscreen display device 116 including a digitizer 152. As described in greater detail with respect to FIG. 3 below, one or more pressure sensitive input devices 130 may be included for providing functionality of for embodiments described herein. A camera 127 may be provided in a front face of the housing 105. The housing 105 may include one or more speakers 150. In the gaming device 100', various input buttons described above, such as the cashout button, gameplay activation button, etc., may be implemented as soft buttons on the touchscreen display device 116 and/or pressure sensitive input device 130. In this embodiment, the pressure sensitive input device 130 is integrated into the touchscreen display device 116, but it should be understood that the pressure sensitive input device may also, or alternatively, be separate from the display device 116. Moreover, the gaming device 100' may omit certain features, such as a bill acceptor, a ticket generator, a coin acceptor or dispenser, a card reader, secondary displays, a bet display, a credit display, etc. Credits can be deposited in or transferred from the gaming device 100' electronically.

Figure 2E:
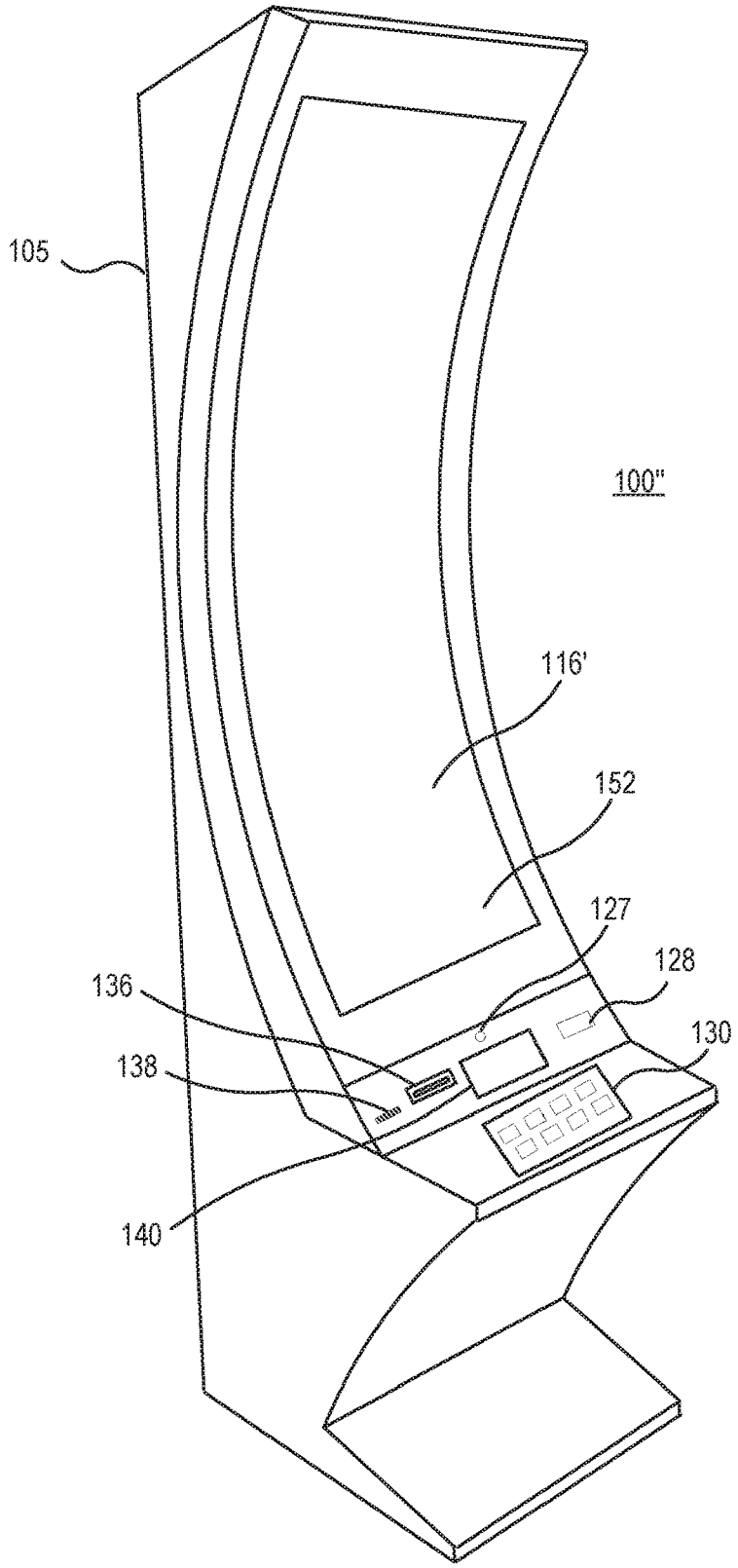
FIG. 2E is a perspective view of a gaming device according to further embodiments.

FIG. 2E illustrates a standalone gaming device 100" having a different form factor from the gaming device 100 illustrated in FIG. 2A. In particular, the gaming device 100" is characterized by having a large, high aspect ratio, curved primary display device 116' provided in the housing 105, with no secondary display device. The primary display device 116' may include a digitizer 152 to allow touchscreen interaction with the primary display device 116'. The gaming device 100" may further include a player tracking display 142, a pressure sensitive input device 130, a bill/ticket acceptor 128, a card reader 138, and a bill/ticket dispenser 136. The gaming device 100" may further include one or more cameras 127 to enable facial recognition and/or motion tracking.

Although illustrated as certain gaming devices, such as electronic gaming machines (EGMs) and mobile devices, similar functions and/or operations as described herein may include wagering stations that may include electronic game tables, conventional game tables including those involving cards, dice and/or roulette, and/or other wagering stations such as sports book stations, video poker games, skill-based games, virtual casino-style table games, or other casino or non-casino style games. Further, gaming devices according to embodiments herein may be implemented using other computing devices and mobile devices, such as smart phones, tablets, and/or personal computers, among others.

Input Device Features

Figure 3:
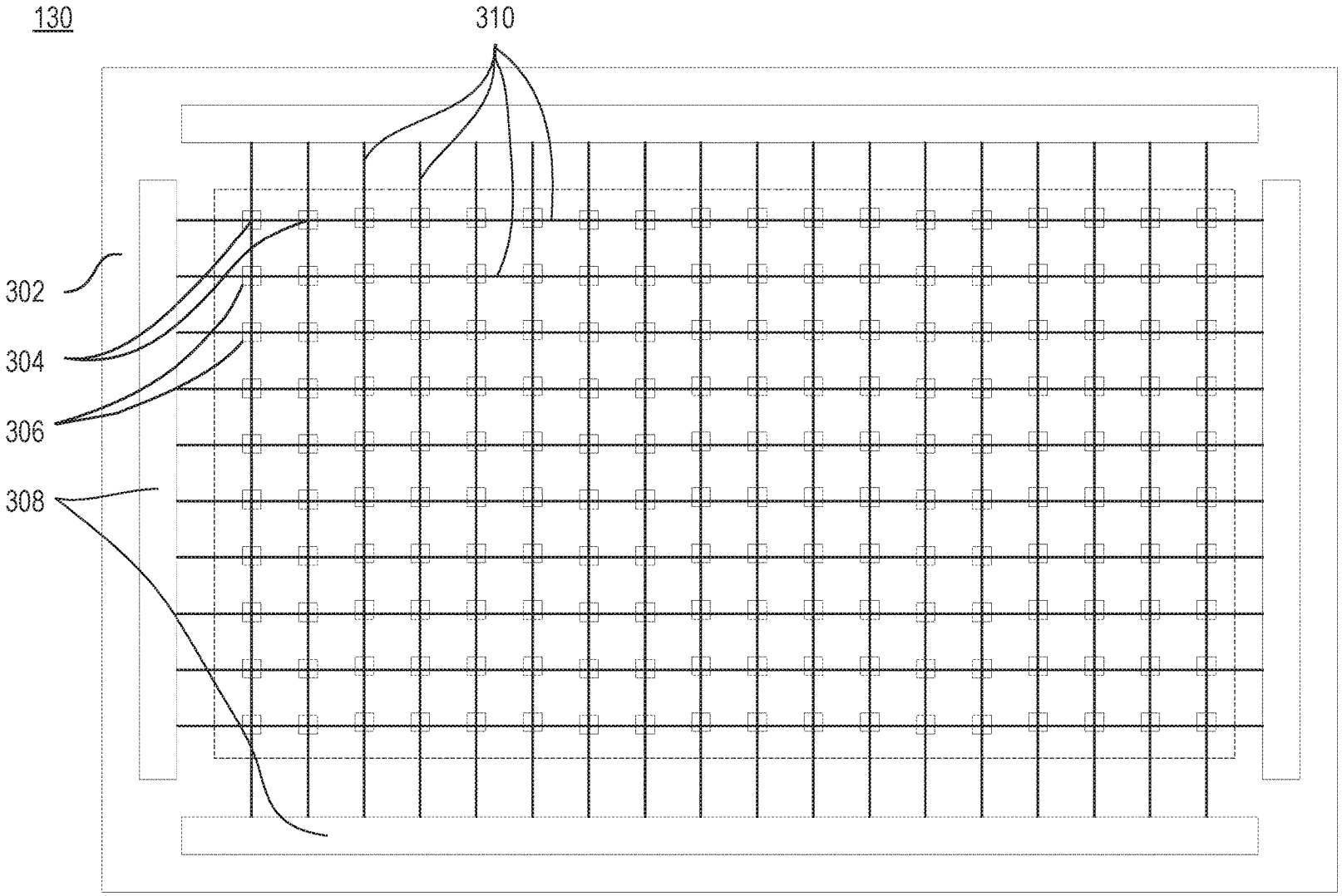
FIG. 3 is a schematic diagram that illustrates various components of an input device according to some embodiments.

Referring now to FIG. 3, a schematic diagram of components of a pressure sensitive input device 130 is are illustrated, according to some embodiments. The pressure sensitive input device 130 includes a printed circuit board 302 having a two-dimensional array of sensor locations 304. A pressure sensitive sensor 306 is located at each sensor location 304 to detect an amount of pressure being applied to the particular sensor location 304, e.g., by a player applying pressure to the sensor location 304 as part of game play. The pressure sensitive sensor 306 may function in a variety of ways. In this example, the pressure sensitive sensors 306 are coupled to one or more controller circuits 308 via one or more conductive lines 310.

In some embodiments, the conductive lines 310 and controller circuit 308 may also, or alternatively, provide capacitive and/or resistive touch screen and/or touch pad functionality. For example, the controller circuits 308 may determine a sensor location 304 through an increase in capacitance of particular conductive lines 310 that intersect at the particular sensor location 304, caused by the player applying pressure to the particular sensor location 304. In another example, the player applying pressure to the particular sensor location 304 may cause the conductive lines that intersect at the particular sensor location 304 to contact each other and conduct a current between the controller circuits 308. In some examples, one or more individual pressure sensitive sensors 306 may associated with each respective sensor location 304, with each individual pressure sensitive sensor 306 independently detecting pressure being applied at the particular sensor location 304. Additional functionality may also include providing feedback, such as audio, visual, and/or haptic feedback, based on an amount of detected pressure at a particular sensor location 304.

It should be understood that a wide variety of pressure sensitive sensors and/or input devices may be used to provide features and functionality described herein. For example, one suitable pressure sensitive input device for many embodiments described herein is the Sensel Morph touch interface, which includes an active area having an array of approximately 20,000 pressure sensors at a density of approximately 6500 sensors per inch. Each sensor is capable of sensing 32,000 levels of pressure in a range between 5 g and 5 kg. The interface can operate at different speeds and latencies, such as a full resolution mode at 125 Hz, which provides greater precision but higher latency (e.g., 8 ms), or a higher speed, lower resolution mode at 500 Hz, which provides lower latency (e.g., 2 ms) but with lower precision.

Other Gaming Device Features

Embodiments described herein may be implemented in various configurations for gaming devices 100*s*, including but not limited to: (1) a dedicated gaming device, wherein the computerized instructions for controlling any games (which are provided by the gaming device) are provided with the gaming device prior to delivery to a gaming establishment; and (2) a changeable gaming device, where the computerized instructions for controlling any games (which are provided by the gaming device) are downloadable to the gaming device through a data network when the gaming device is in a gaming establishment. In some embodiments, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In some embodiments, a gaming device may be operated by a mobile device, such as a mobile telephone, tablet other mobile computing device. For example, a mobile device may be communicatively coupled to a gaming device and may include a user interface that receives user inputs that are received to control the gaming device. The user inputs may be received by the gaming device via the mobile device.

In some embodiments, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more gaming devices; and/or (c) one or more personal gaming devices, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the gaming device are executed by the central server, central controller, or remote host. In such "thin client" embodiments, the central server, central controller, or remote host remotely controls any games (or other suitable interfaces) displayed by the gaming device, and the gaming device is utilized to display such games (or suitable interfaces) and to receive one or more inputs or commands. In other such embodiments, computerized instructions for controlling any games displayed by the gaming device are communicated from the central server, central controller, or remote host to the gaming device and are stored in at least one memory device of the gaming device. In such "thick client" embodiments, the at least one processor of the gaming device executes the computerized instructions to control any games (or other suitable interfaces) displayed by the gaming device.

In some embodiments in which the gaming system includes: (a) a gaming device configured to communicate with a central server, central controller, or remote host through a data network; and/or (b) a plurality of gaming devices configured to communicate with one another through a data network, the data network is an internet or an intranet. In certain such embodiments, an internet browser of the gaming device is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the gaming device, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the gaming device.

It should be appreciated that the central server, central controller, or remote host and the gaming device are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of gaming devices to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

Pressure Sensitive Input Features

By providing pressure sensitive input features, human machine interactions between players and gaming devices may be enhanced by offering players additional control and functionalities. Such functionality may include pushing the input device at a particular sensor location to exceed a defined pressure threshold and generate a response, such as a haptic response for example. This functionality may simulate pressing physical buttons or interaction with other mechanical devices in some examples.

Figure 4:
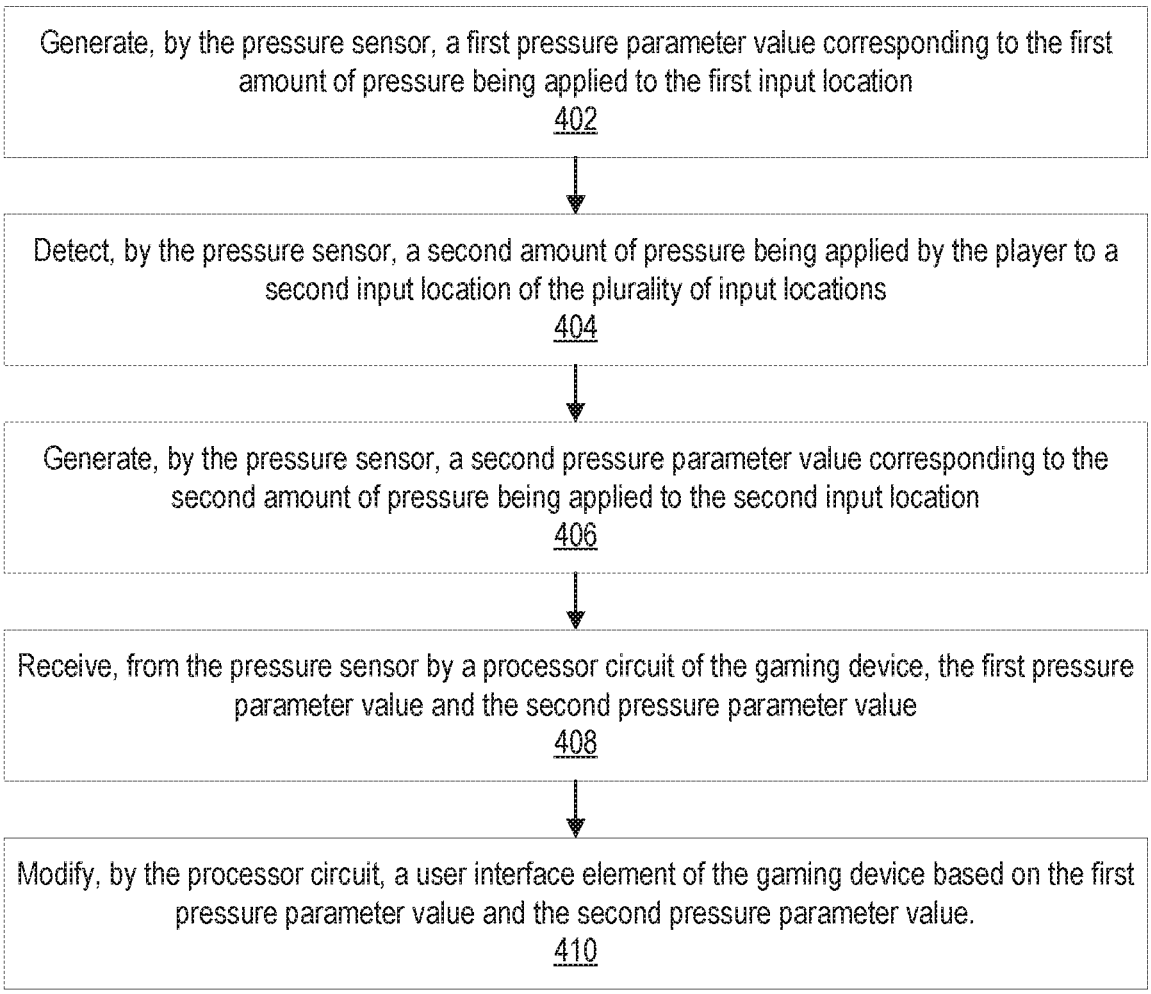
FIG. 4 is a flowchart illustrating operations of systems/methods according to some embodiments.

In some examples, an amount of pressure may be detected at multiple sensor locations simultaneously to provide one or more inputs for the gaming device. In this regard, FIG. 4 is a flowchart illustrating operations of systems/methods according to some embodiments. The operations 400 may include detecting, by a pressure sensor of an input device of a gaming device, a first amount of pressure being applied by a player to a first input location of a plurality of input locations (Block 402). The operations 400 may further include generating, by the pressure sensor, a first pressure parameter value corresponding to the first amount of pressure being applied to the first input location (Block 404). The operations 400 detecting, by the pressure sensor, a second amount of pressure being applied by the player to a second input location of the plurality of input locations (Block 406). The operations 400 may further include generating, by the pressure sensor, a second pressure parameter value corresponding to the second amount of pressure being applied to the second input location (Block 408). The operations 400 may further include receiving, from the pressure sensor by a processor circuit of the gaming device, the first pressure parameter value and the second pressure parameter value (Block 410). The operations 400 may further include modifying, by the processor circuit, a user interface element of the gaming device based on the first pressure parameter value and the second pressure parameter value (Block 412). In some embodiments, modifying the user interface element may include modifying a first user interface element associated with the first input location based on both the first pressure parameter value and the second pressure parameter value. Alternatively, or in addition, modifying the user interface element may include modifying a second user interface element associated with the second input location based on both the first pressure parameter value and the second pressure parameter value.

It should also be understood that devices and systems described herein may perform some or all of the disclosed operations 400. For example, a gaming device 100 and components thereof of FIGS. 1-3 above may have an input device, a processor circuit, and a memory to perform these and similar operations.

Figure 5:
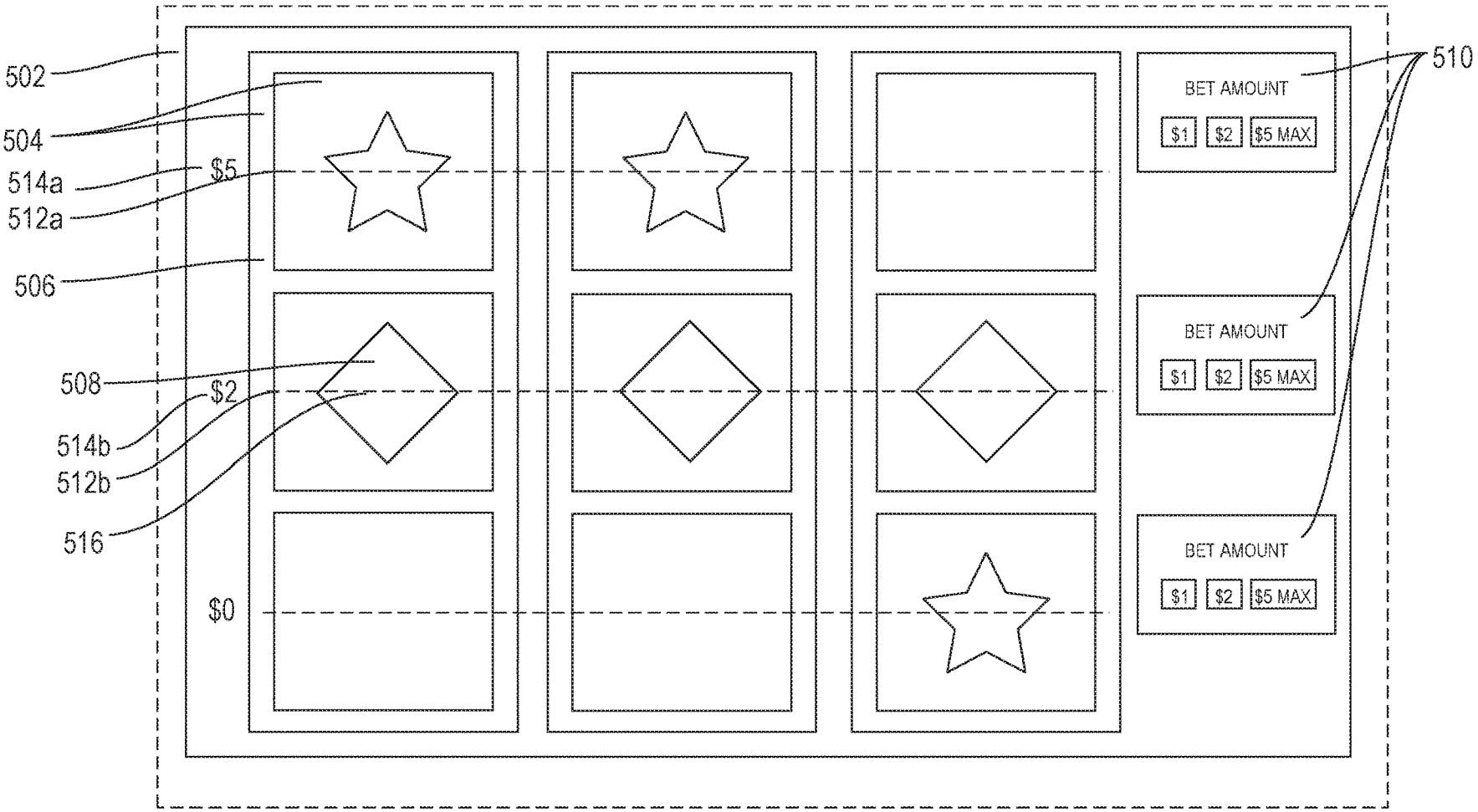
FIG. 5 is a schematic screenshot illustrating using an application according to some embodiments of the inventive concept.

The user interface element(s) may be modified in many different ways, in response to different pressure and location inputs. For example, FIG. 5 is a schematic screenshot illustrating using an application according to some embodiments of the inventive concept. In this example, a graphical user interface (GUI) 502 of a gaming device includes a plurality of game elements 504, including a plurality of slot reels 506 and symbols 508, and elements representative of game parameters, such as a bet amount element 510 that can be modified to any number of amounts between a minimum bet amount and a maximum bet amount.

The game elements 504 further include a plurality of win-line elements 512, where each win-line element 512 may be associated with its own wager amount 514 and win condition. In this example, in response to a first pressure parameter value associated with a first input location meeting a first predetermined pressure threshold, a first wager amount 514*a* for a first win-line element 512*a* of a wagering game of the gaming device may be increased or decreased. At the same time, in response to a second pressure parameter value associated with a second input location meeting a second predetermined pressure threshold, a second wager amount 514*b* for a second win-line element 512*b* of a wagering game of the gaming device may be independently increased or decreased.

In another embodiment, based on the first pressure parameter value and the second pressure parameter value, a win-line element 512 may move to a predetermined position 516 corresponding to a winning combination of symbols 508.

The different inputs may also independently control aspects of the wagering game during play. For example, a graphical spinning first reel 506*a* of a wagering game of the gaming device may stop spinning in response to the first pressure parameter value meeting a first predetermined pressure threshold in response to the first pressure parameter value meeting a predetermined pressure threshold, and a graphical spinning second reel 506*b* may stop spinning in response to the second pressure parameter value meeting a second predetermined pressure threshold. The game result of the wagering game may be based in part on positions of the first reel 506*a* and the second reel 506*b* after the first reel 506*a* and the second reel 506*b* stop spinning. For example, if the first reel 506*a* and second reel 506*b* position a winning combination of symbols 508 along a particular win-line element 512, the game result will be a winning result according to the parameters of the win-line element 512. In this manner, the player may independently influence individual reels 506 of the wagering game to increase the player's chances of winning and overall enjoyment of the wagering game.

Figure 6:
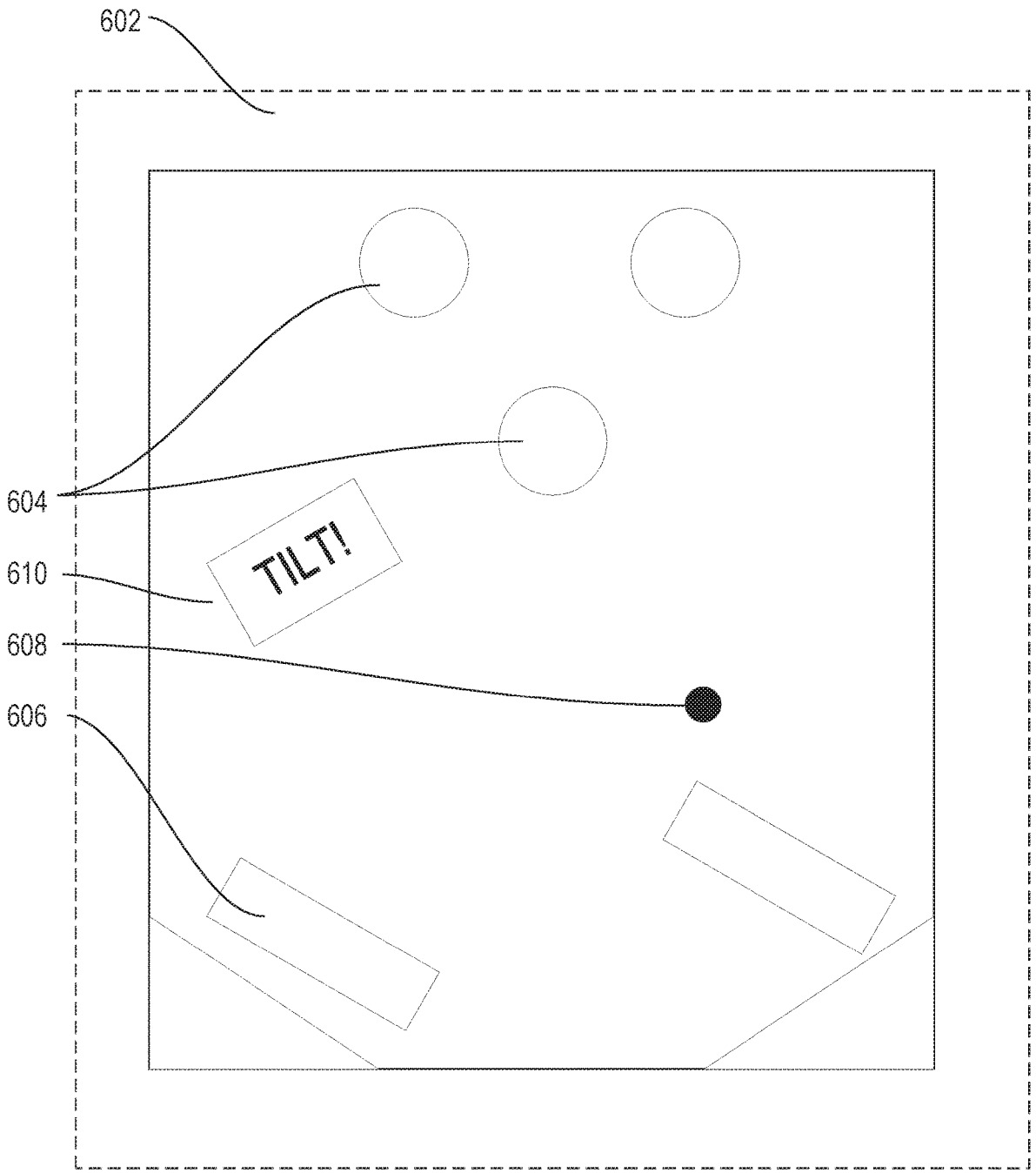
FIG. 6 is a schematic screenshot illustrating using an application according to some embodiments of the inventive concept.

FIG. 6 is a schematic screenshot illustrating using an application according to some embodiments of the inventive concept. In this example, a GUI 602 of a gaming device includes a plurality of pinball game elements 604 simulating play of a pinball game. The individual pressure sensitive inputs may simulate independently pressing mechanical buttons to operate graphical pinball paddles 606 to deflect a graphical pinball 608. The pressure sensitive inputs may also cause an entire graphical pinball play area 610 to tilt to modify the path of the graphical pinball 608.

Figure 7:
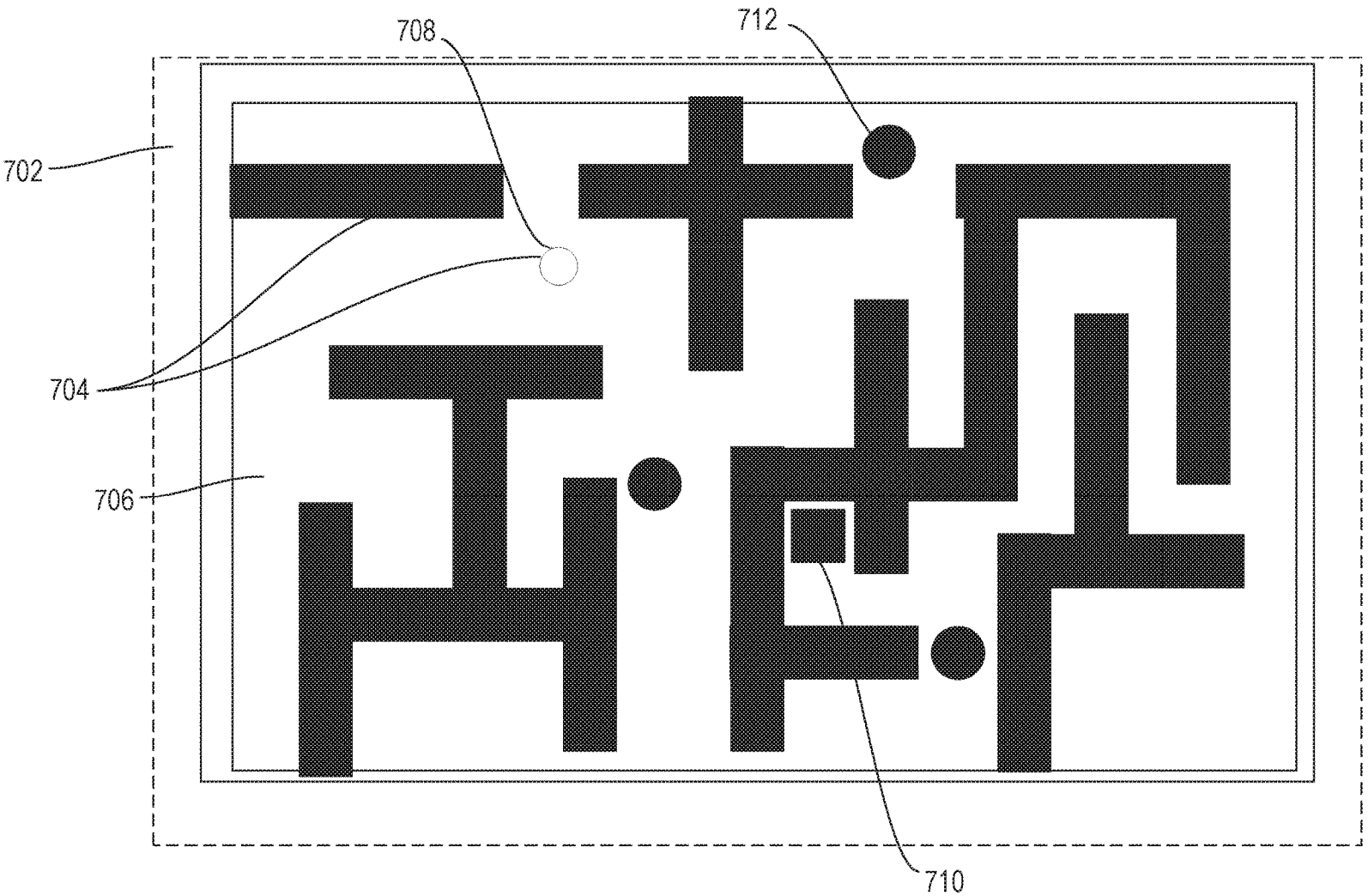
FIG. 7 is a schematic screenshot illustrating using an application according to some embodiments of the inventive concept.

FIG. 7 is a schematic screenshot illustrating using an application according to some embodiments of the inventive concept. In this example, a GUI 702 of a gaming device includes a plurality of maze game elements 704 simulating play of a tilting maze game. For example, in response to the first pressure parameter value and the second pressure parameter value corresponding to different pressure amounts being applied at different locations of the graphical maze play area 706, the graphical maze play area 706 may tilt to modify a path of a graphical rolling ball 708 through the maze play area 706, for example, to guide the graphical rolling ball 708 toward a goal 710 and/or avoid obstacles and hazards 712.

Figure 8:
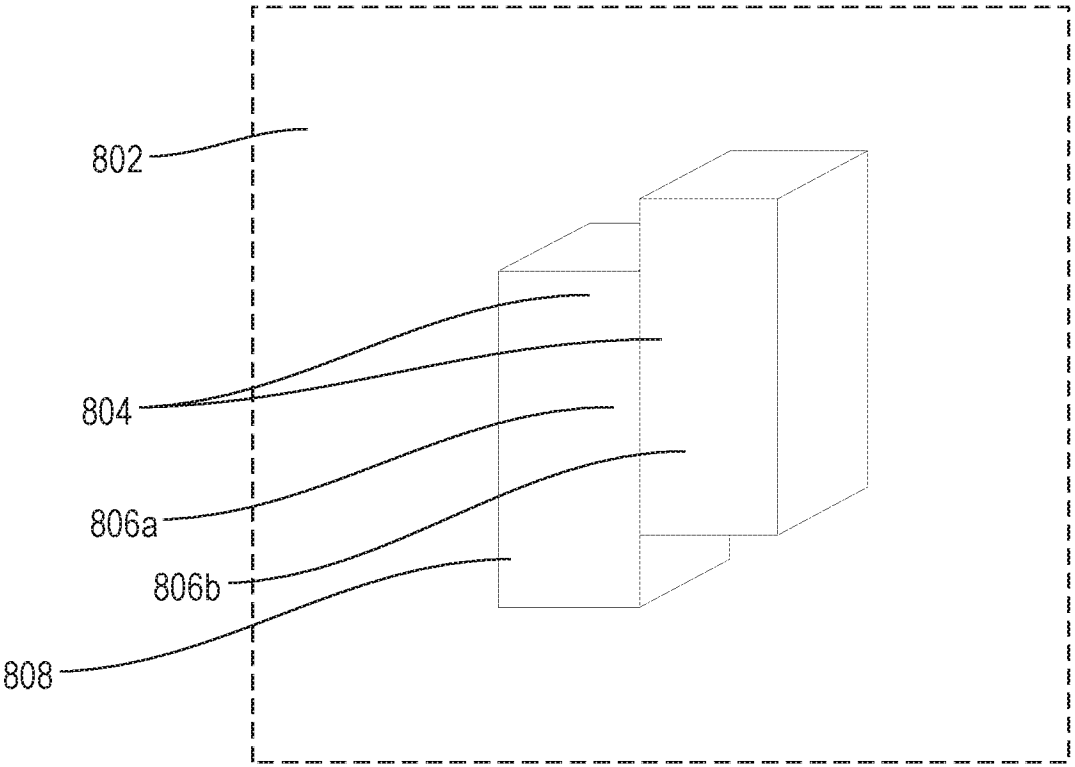
FIG. 8 is a schematic screenshot illustrating using an application according to some embodiments of the inventive concept.

FIG. 8 is a schematic screenshot illustrating using an application according to some embodiments of the inventive concept. In this example, a GUI 802 of a gaming device includes a plurality of puzzle game elements 804 simulating play of a puzzle container or puzzle box game. For example, in response to the first pressure parameter value and the second pressure parameter value, a first graphical puzzle container element 806*a* may be moved in a first direction with respect to a second graphical puzzle container element 806*b*. For example, the goal of the wagering game may be to unlock the puzzle container 808 by using different pressure and location sensitive inputs to manipulate the graphical puzzle container elements 806 with respect to each other, to release an award within the puzzle container 808. In some embodiments, if a pressure exceeds predetermined amount, the puzzle container 808 may break, causing the player to lose the game.

Figure 9:
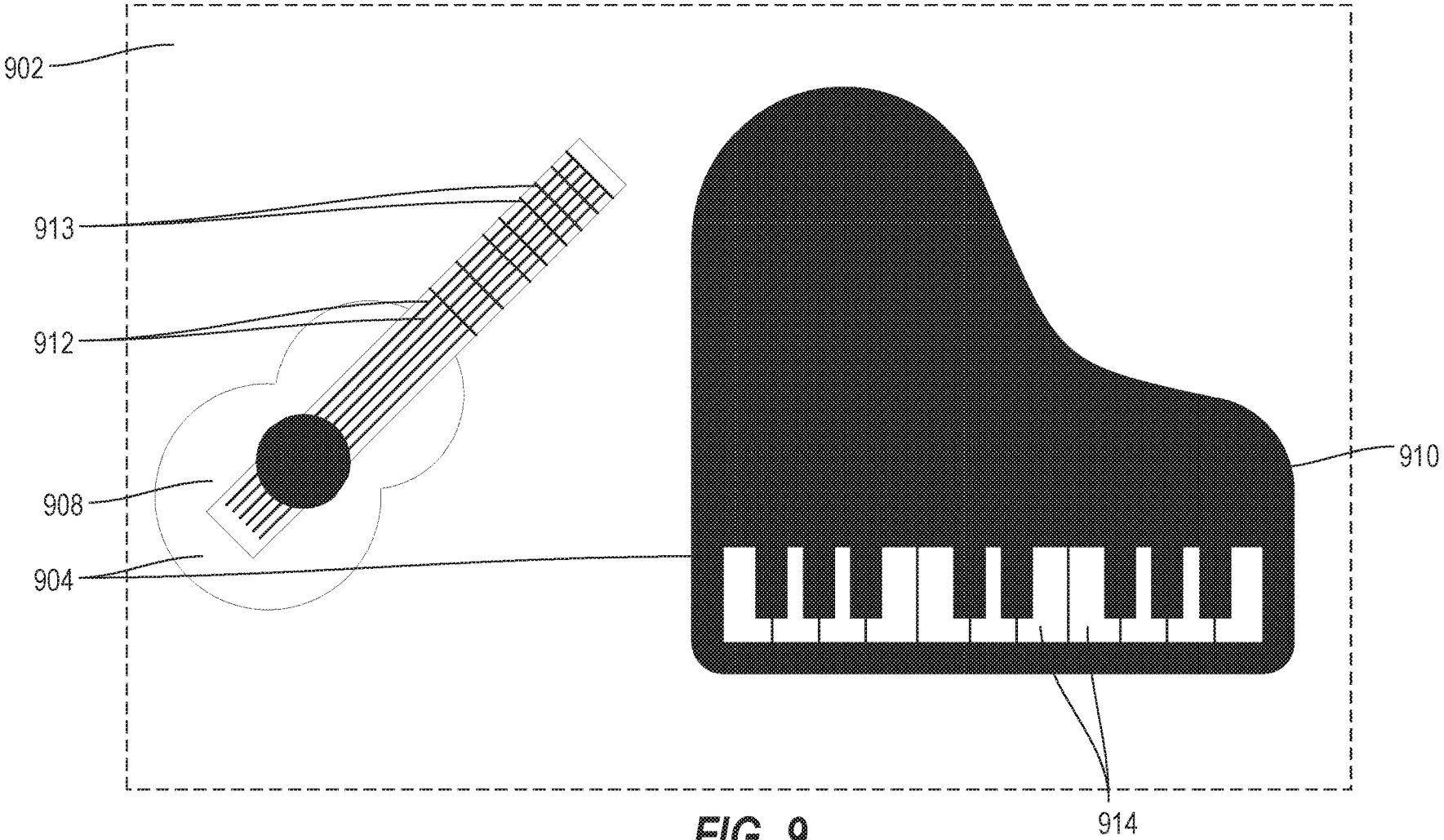
FIG. 9 is a schematic screenshot illustrating using an application according to some embodiments of the inventive concept.

FIG. 9 is a schematic screenshot illustrating using an application according to some embodiments of the inventive concept. In this example, a GUI 902 of a gaming device includes a plurality of graphical musical instrument elements 904 simulating play of musical instruments, such as a guitar 908 and/or piano 910. In this example, the graphical guitar 908 has a plurality of graphical strings 912 and graphical frets 913, and the graphical piano 910 has a plurality of graphical keys 914. In this example, in response to the first pressure parameter value meeting a first pressure threshold value, a first sound at a first volume may be generated, e.g., by simulating striking one or more piano keys 914 corresponding to the input location associated with the first pressure parameter value. In response to the first pressure parameter value failing to meet the first pressure threshold value, the first sound may be generated at a second volume lower than the first volume. In response to the second pressure parameter value meeting a second pressure threshold value, a second sound at a third volume may be generated, corresponding to a note played by a different key 914 of the graphical piano 910. Similarly, in response to the second pressure parameter value failing to meet the second pressure threshold value, the second sound may be generated at a fourth volume lower than the third volume.

Similarly, the graphical guitar strings 912 and/or frets 913 may be manipulated to generate sounds having additional properties, based on the different measured pressure amounts and locations on the input device. For example, in response to the first pressure parameter value meeting a first pressure threshold value, a first sound comprising a first attack value may be generated, corresponding to a note played by a string 912 of the guitar 908. In response to the first pressure parameter value failing to meet the first pressure threshold value, the first sound is generated having a second attack value lower than the first attack value. Likewise, in response to the second pressure parameter value meeting a second pressure threshold value, a second sound is generated having a third attack value, the second sound corresponding to a note played by another string 912 of the guitar 908, and, in response to the second pressure parameter value failing to meet the second pressure threshold value, the second sound is generated having a fourth attack value than the third attack value. In these and other embodiments, different fingers may apply different amounts of pressure to create complex inputs.

Figure 10:
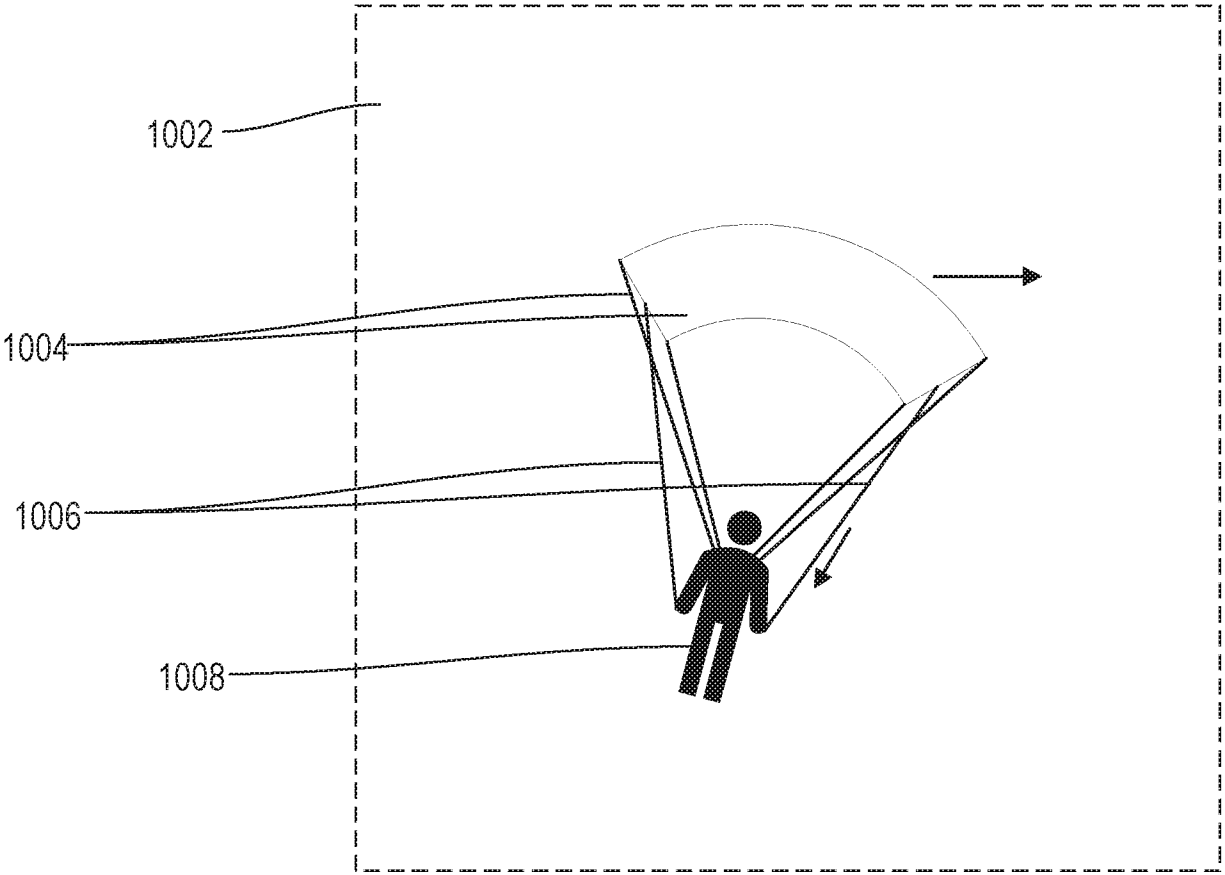
FIG. 10 is a schematic screenshot illustrating using an application according to some embodiments of the inventive concept.

FIG. 10 is a schematic screenshot illustrating using an application according to some embodiments of the inventive concept. In this example, a GUI 1002 of a gaming device includes a plurality of parachute elements 1004 simulating a skydiving game. In this example, in response to the first pressure parameter value, a graphical first parachute cable 1006*a* steers a skydiver character 1008 in a first direction, and, in response to the second pressure parameter value, a graphical second parachute cable 1006*b* steers the skydiver character 1008 in another direction. The cables 1006 and/or other controls may further be used to control a rate of descent or control other aspects of the skydiving game, as desired.

Figure 11:
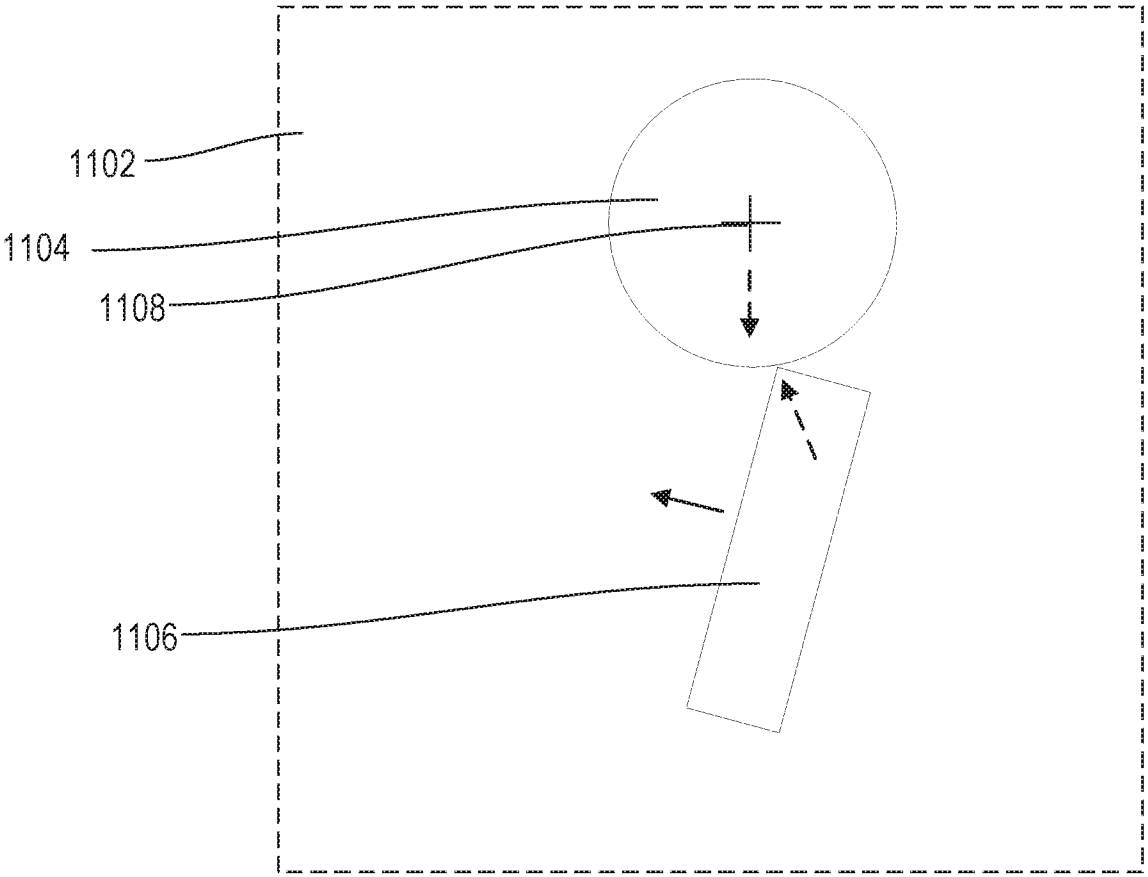
FIG. 11 is a schematic screenshot illustrating using an application according to some embodiments of the inventive concept.

FIG. 11 is a schematic screenshot illustrating using an application according to some embodiments of the inventive concept. In this example, a GUI 1102 of a gaming device includes a graphical balanced object 1104 balanced on a graphical support object 1106. The graphical balanced object 1104 has a virtual center of gravity 1108 that can be modified by moving the graphical support object 1106 beneath the graphical balanced object 1104 based on pressure and location based inputs corresponding to the graphical support object 1106. Based on the pressure parameter values, the graphical support object 1106 is moved to modify the virtual center of gravity 1108 of the graphical balanced object 1104 to balance the graphical balanced object 1104 on the graphical support object 1106.

Figure 12:
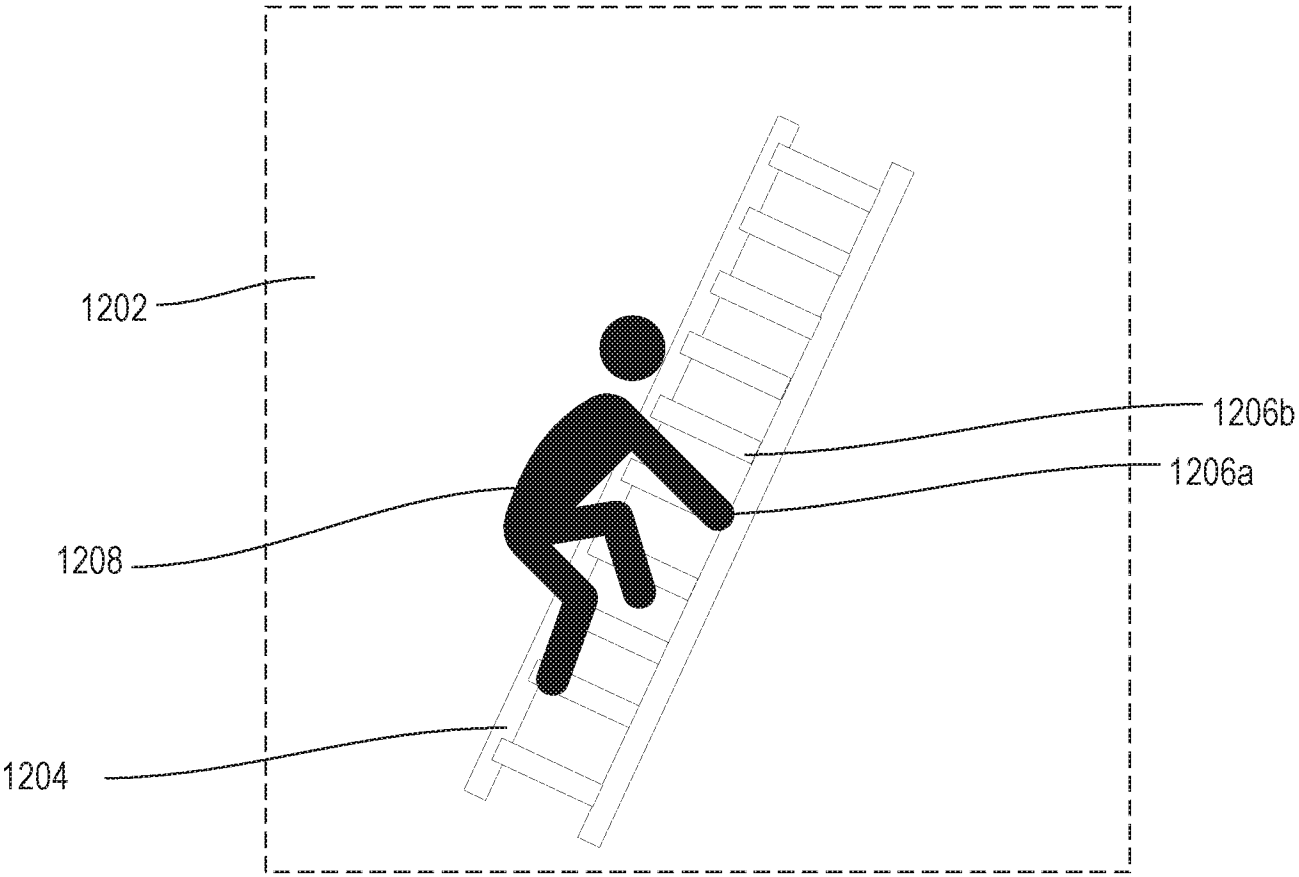
FIG. 12 is a schematic screenshot illustrating using an application according to some embodiments of the inventive concept.

FIG. 12 is a schematic screenshot illustrating using an application according to some embodiments of the inventive concept. In this example, a GUI 1202 of a gaming device includes a graphical ladder 1204 having a plurality of rungs 1206 that may be climbed by a character avatar 1208. In this example, in response to the first pressure parameter value, a character avatar 1208 pulls on a first rung 1206*a* of the graphical ladder 1204 to cause the character avatar 1208 to climb the graphical ladder 1204. Similarly, in response to the second pressure parameter value, the character avatar 1208 pulls on the next rung 1206*b* of the graphical ladder 1204 to cause the character avatar 1208 to further climb the graphical ladder 1204.

Further Definitions and Embodiments

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processing circuit of a general purpose computer, special purpose computer, or other programmable data processing apparatus to produce a machine, such that the instructions, which execute via the processing circuit of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A gaming device comprising:

an input device comprising a plurality of input locations and a pressure sensor to detect, for each input location of the plurality of input locations, an amount of pressure applied to the input device at the input location by a player of the gaming device;

a processor circuit; and a memory coupled to the processor circuit, the memory comprising machine-readable instructions that, when executed by the processor circuit, cause the processor circuit to:

receive, from the pressure sensor, a first pressure parameter value corresponding to a first amount of pressure being applied to a first input location of the plurality of input locations by the player;

receive, from the pressure sensor, a second pressure parameter value corresponding to a second amount of pressure being applied to a second input location of the plurality of input locations by the player, the second input location being different than the first input location; and responsive to receiving the first pressure parameter value and receiving the second pressure parameter value, modify a user interface element of the gaming device associated with the first input location based on the first pressure parameter value and the second pressure parameter value.

2. The gaming device of claim 1, wherein the instructions to modify the user interface element further cause the processor circuit to:

modify a second user interface element associated with the second input location based on the first pressure parameter value and the second pressure parameter value.

3. The gaming device of claim 1, wherein the instructions to modify the user interface element further cause the processor circuit to:

increase a first wager amount for a first win-line element of a wagering game of the gaming device in response to the first pressure parameter value meeting a first predetermined pressure threshold; and increase a second wager amount for a second win-line element of the wagering game of the gaming device in response to the second pressure parameter value meeting a second predetermined pressure threshold.

4. The gaming device of claim 1, wherein the instructions to modify the user interface element further cause the processor circuit to:

move a win-line element of a wagering game of the gaming device to a predetermined position over a graphical array of reel symbols based on the first pressure parameter value and the second pressure parameter value, wherein the predetermined position over the graphical array of reel symbols corresponds to a winning combination of reel symbols.

5. The gaming device of claim 1, wherein the instructions to modify the user interface element further cause the processor circuit to:

cause a graphical spinning first reel of a wagering game of the gaming device to stop spinning in response to the first pressure parameter value meeting a first predetermined pressure threshold; and cause a graphical spinning second reel to stop spinning in response to the second pressure parameter value meeting a second predetermined pressure threshold, wherein a game result of the wagering game is based in part on positions of the first reel and the second reel after the first reel and the second reel stop spinning.

6. The gaming device of claim 1, wherein the instructions to modify the user interface element further cause the processor circuit to:

cause a graphical pinball play area to tilt to modify a path of a graphical pinball in response to the first pressure parameter value and the second pressure parameter value.

7. The gaming device of claim 1, wherein the instructions to modify the user interface element further cause the processor circuit to:

cause a graphical maze play area to tilt to modify a path of a graphical rolling ball through the graphical maze play area in response to the first pressure parameter value and the second pressure parameter value.

8. The gaming device of claim 1, wherein the instructions to modify the user interface element further cause the processor circuit to:

move a first graphical puzzle container element in a first with respect to a second graphical puzzle container element in a first direction in response to the first pressure parameter value and the second pressure parameter value.

9. The gaming device of claim 1, wherein the instructions to modify the user interface element further cause the processor circuit to:

in response to the first pressure parameter value meeting a first pressure threshold value, generate a first sound at a first volume, the first sound corresponding to a note played by a first musical instrument key of a graphical musical instrument of a user interface of the gaming device corresponding to the first input location;

in response to the first pressure parameter value failing to meet the first pressure threshold value, generate the first sound at a second volume lower than the first volume;

in response to the second pressure parameter value meeting a second pressure threshold value, generate a second sound at a third volume, the second sound corresponding to a note played by a second musical instrument key of the graphical musical instrument corresponding to the second input location; and in response to the second pressure parameter value failing to meet the second pressure threshold value, generate the second sound at a fourth volume lower than the third volume.

10. The gaming device of claim 1, wherein the instructions to modify the user interface element further cause the processor circuit to:

in response to the first pressure parameter value meeting a first pressure threshold value, generate a first sound comprising a first attack value, the first sound corresponding to a note played by a first musical instrument string of a graphical musical instrument of a user interface of the gaming device corresponding to the first input location;

in response to the first pressure parameter value failing to meet the first pressure threshold value, generate the first sound comprising a second attack value lower than the first attack value;

in response to the second pressure parameter value meeting a second pressure threshold value, generate a second sound comprising a third attack value, the second sound corresponding to a note played by a second musical instrument string of the graphical musical instrument corresponding to the second input location; and in response to the second pressure parameter value failing to meet the second pressure threshold value, generate the second sound comprising a fourth attack value than the third attack value.

11. The gaming device of claim 1, wherein the instructions to modify the user interface element further cause the processor circuit to:

in response to the first pressure parameter value, cause a graphical first parachute cable of a user interface of the gaming device to steer a skydiver character of the user interface in a first direction; and in response to the second pressure parameter value, cause a graphical second parachute cable of the user interface to steer the skydiver character of the user interface in a second direction.

12. The gaming device of claim 1, wherein the instructions to receive the first pressure parameter value further cause the processor circuit to receive an indication of the first input location, the first pressure parameter value being separate from the indication of the first input location, and wherein the instructions to receive the second pressure parameter value further cause the processor circuit to receive an indication of the second input location, the second pressure parameter value being separate from the indication of the second input location.

13. The gaming device of claim 1, wherein the first pressure parameter value exceeds a predetermined threshold indicating that the first input location has been pressed, and wherein the second pressure parameter value exceeds the predetermined threshold indicating that the second input location has been pressed.

14. A method comprising detecting, by a pressure sensor of an input device of a gaming device, a first amount of pressure being applied by a player to a first input location of a plurality of input locations;

generating, by the pressure sensor, a first pressure parameter value corresponding to the first amount of pressure being applied to the first input location;

detecting, by the pressure sensor, a second amount of pressure being applied by the player to a second input location of the plurality of input locations, the second input location being different than the first input location;

generating, by the pressure sensor, a second pressure parameter value corresponding to the second amount of pressure being applied to the second input location;

receiving, from the pressure sensor by a processor circuit of the gaming device, an indication of the first input location, an indication of the second input location, the first pressure parameter value, and the second pressure parameter value, the first pressure parameter value being separate from the indication of the first input location and the second pressure parameter value being separate from the indication of the second input location; and responsive to receiving the indication of the first input location, the indication of the second input location, the first pressure parameter value, and the second pressure parameter value, determine, by the processor circuit, a modification value for a graphical user interface element of the gaming device based on the first pressure input location, the first pressure parameter value, the second pressure input location, and the second pressure parameter value;

modifying, by the processor circuit, the graphical user interface element of the gaming device based on the modification value.

15. The method of claim 14, wherein modifying the user interface element comprises:

modifying a first user interface element associated with the first input location based on the first pressure parameter value and the second pressure parameter value.

16. The method of claim 15, wherein modifying the user interface element comprises:

modifying a second user interface element associated with the second input location based on the first pressure parameter value and the second pressure parameter value.

17. The method of claim 14, wherein the modification value comprises a tilt angle value and a tilt direction value for the graphical user interface element, and wherein modifying the graphical user interface element comprises tilting the graphical user interface element to modify a path of a second graphical user interface element.

18. A system comprising a processor circuit; and a memory coupled to the processor circuit, the memory comprising machine-readable instructions that, when executed by the processor circuit, cause the processor circuit to:

receive, from the pressure sensor, an indication of a first input location of the plurality of input locations and a first pressure parameter value corresponding to a first amount of pressure being applied to the first input location, the first pressure parameter value being separate from the indication of the first input location;

receive, from the pressure sensor, an indication of a second input location of the plurality of input locations and a second pressure parameter value corresponding to a second amount of pressure being applied to the second input location, the second pressure parameter value being separate from the indication of the second input location, and the second input location being different than the first input location; and responsive to receiving the indication of the first input location and first pressure parameter value and receiving the second input location and the second pressure parameter value, modify a graphical user interface element of the gaming device based on the first pressure parameter value and the second pressure parameter value, the graphical user element comprising a reel of a wagering game.

19. The system of claim 18, the reel comprising a first reel associated with the first input location and a second reel associated with the second input location.

* * * * *